US005435559A

United States Patent [19]

Swisshelm

[11] Patent Number: 5,435,559

[45] Date of Patent: Jul. 25, 1995

[54] SET OF IRONS WITH PROGRESSIVE WEIGHTING SYSTEM

[75] Inventor: Charles T. Swisshelm, Tustin, Calif.

[73] Assignee: Echelon Golf, City of Industry, Calif.

[21] Appl. No.: 295,234

[22] Filed: Aug. 24, 1994

[51] Int. Cl.[6] ..... A63B 53/04

[52] U.S. Cl. ..... 273/169; 273/167 F; 273/167 H; 273/77 A

[58] Field of Search ..... 273/167 R, 167 A, 167 D, 273/167 F, 167 H, 169, 171, 193 R, 194 B, 162 R, 77 R, 77 A; D21/220

[56] References Cited

U.S. PATENT DOCUMENTS

| | | |
|---|---|---|
| 1,089,881 | 0/1914 | Taylor, Jr. . |
| 3,862,759 | 1/1975 | Evans et al. . |
| 4,650,191 | 3/1987 | Mills . |
| 4,754,977 | 7/1988 | Sahm . |
| 4,826,172 | 5/1989 | Antonious . |
| 4,919,430 | 4/1990 | Antonious . |
| 4,932,658 | 6/1990 | Antonious . |
| 4,938,470 | 7/1990 | Antonious . |
| 5,014,993 | 5/1991 | Antonious . |
| 5,026,056 | 6/1991 | McNally et al. . |
| 5,046,733 | 9/1991 | Antonious . |
| 5,100,146 | 3/1992 | Antonious . |
| 5,125,662 | 6/1992 | Antonious . |
| 5,280,911 | 1/1994 | Katayama . |
| 5,297,803 | 3/1994 | Solheim . |
| 5,328,184 | 7/1994 | Antonious ..... 273/169 |

FOREIGN PATENT DOCUMENTS 5-49714 3/1993 Japan .

*Primary Examiner*—Sebastiano Passaniti
*Attorney, Agent, or Firm*—Raymond Sun

[57] ABSTRACT

A set of iron golf clubs, with each golf club comprising a shaft and a club head. Each club head comprises a sole, a rear surface and a ball-striking face having a center of percussion. Each club head further comprises a first weight provided adjacent the sole and a second weight provided on the rear surface, the second weight comprising at least two rails, with a first rail positioned between the center of percussion and the toe portion, and a second rail positioned between the center of percussion and the heel portion. The weight and width of the first and second rails are progressively varied for each club head in the set. A third weight is also provided on the rear surface of each club head, and may also be progressively weighted. Depending on the particular club head within the set, the third weight may be positioned between the first rail and the toe portion, or between the second rail and the heel portion.

10 Claims, 4 Drawing Sheets

SET OF IRONS WITH PROGRESSIVE WEIGHTING SYSTEM

BACKGROUND OF THE INVENTION

1. Field Of The Invention

The present invention relates to golf clubs, and in particular, to a set of irons having a progressive weighting system in which the weighting or mass of each club is adjusted or varied depending on the particular club within the set.

2. Description Of The Related Art

Traditional iron club heads were made of forged carbon steel, which in essence is a hot piece of metal that is stamped at great force through hydraulics to form a club into a desired shape.

In the early 1970's, a process was designed for investment cast steel to be shaped in the configuration of a golf club head. Specifically, a mold is made and liquid metal is poured into the mold and allowed to harden. The metal is then finished to have the desired features. One benefit enjoyed by iron golf clubs made from this process is that one is able to easily distribute weight or mass to the desired locations. Since forged carbon steel required large forces to stamp the metal, it presented many limitations with regards to distributing weight around the club head. However, with investment casting, one is able to design a mold having sharp angles, corners and other requirements which facilitate the desired weight distribution. When investment cast irons were first introduced, "perimeter-weighting" was a much publicized feature. Specifically, in a perimeter-weighted iron club head, the weight or mass is concentrated on the outer perimeter of the golf club so that weight or mass could be evenly distributed around the entire club head. This essentially expanded the size of the center of percussion or "sweet spot" of the club face, thereby allowing the club head to be more "forgiving" to shots that were hit off-center. In a typical perimeter-weighted iron, the weighted perimeter would also define a cavity in the rear of the club head, so these clubs were also commonly referred to as "cavity-back" irons.

Notwithstanding the above developments, numerous attempts were still made to distribute the weight or mass around different areas of an iron club head to achieve particular objectives. For example, attempts were made to provide discrete weights at specific areas of the club head, as illustrated in U.S. Pat. Nos. 1,089,881 to Taylor, Jr., 4,650,191 to Mills, 4,754,977 to Sahm, 5,100,146 to Antonious, and 5,280,911 to Katayama.

Other attempts have focused on providing a cavity-back perimeter-weighted club head with secondary weight members provided within the cavity, as illustrated in U.S. Pat. Nos. 4,826,172, 4,919,430, 4,932,658, 4,938,470, 5,014,993, and 5,046,733, all to Antonious.

Further attempts have included modifications to the sole of the club head, as illustrated in U.S. Pat. Nos. 3,862,759 to Evans et al. and 5,125,662 to Antonious.

Other attempts have been made to redistribute the weighting of a club head. For example, U.S. Pat. No. 5,297,803 to Solheim provides a perimeter-weighted club head in which the weight or mass along the perimeter is varied at different locations. U.S. Pat. No. 5,026,056 to McNally et al. provide a pair of weight pads 57, 58 inside the back cavity of the club head, the pads 57, 58 progressively changing configurations through the successively lofted clubs, from the two-iron to the wedges, to redistribute the weight in each club's back cavity to have each club's center of gravity positioned directly behind the club head's center of percussion. JP 5-49714 to Katayama describes a set of iron club heads having a plurality of ribs positioned in the back of the club head, with the weight of the ribs varied depending on the club to increase the depth of the center of gravity of each club head and the moment of inertia around the center of gravity.

Notwithstanding the above-described efforts and improvements, there still remains a need for an iron club head which assists the average golfer in hitting the ball further and more accurately.

SUMMARY OF THE INVENTION

The objects of the present invention may be achieved by providing a set of iron golf clubs, with each golf club comprising a shaft and a club head. Each club head comprises a sole, a toe portion, a heel portion, a rear surface, and a ball-striking face having a center of percussion located at an approximate center of the face, the center of percussion having a first extremity closer to the toe portion and a second extremity closer to the heel portion. Each club head further comprises a first weight provided adjacent the sole and a second weight provided on the rear surface, the second weight comprising at least two rails, with a first rail positioned between the first extremity and the toe portion, and a second rail positioned between the second extremity and the heel portion. The set of iron golf clubs includes a plurality of higher-numbered iron golf clubs and a plurality of lower-numbered iron golf clubs, with the higher-numbered iron golf clubs having shafts that are shorter than the shafts of the lower-numbered iron golf clubs, and whose faces have a loft with a higher angle than the loft of the lower-numbered iron golf clubs.

Each of the club heads of the plurality of lower-numbered clubs further comprises a third weight provided on the rear surface between the first rail and the toe portion. The first rail of each lower-numbered iron golf club is progressively narrower than the first rail of the preceding lower-numbered iron golf club, and the second rail of each lower-numbered iron golf club is progressively wider than the second rail of the preceding lower-numbered iron golf club.

Each of the club heads of the plurality of higher-numbered clubs further comprises a third weight provided on the rear surface between the second rail and the heel portion. The second rail of each higher-numbered iron golf club is progressively wider than the second rail of the preceding higher-numbered iron golf club, and the first rail of each higher-numbered iron golf club is progressively narrower than the first rail of the preceding higher-numbered iron golf club.

Each of the first and second rails is slanted at an angle that corresponds to the angle between the hosel and the sole, and comprises a bottom terminating at the sole. The first and second rails have a greater thickness near their bottom than near their upper tips. The sole further comprises three beveled regions separated by two flat regions.

Therefore, the iron golf club of the present invention promotes greater accuracy and increased distance on golf shots by providing an iron club head which concentrates more weight or mass at specific locations. This is accomplished by providing three types of weights, (1) a sole weight for increasing the trajectory of the shot, (2) a pair of rails provided behind approximately the center of percussion to provide support and accuracy to shots that are struck on the toe or heel portions of the club face, and (3) one or two weight pieces provided adjacent the heel and toe portions to create a counterbalance for long or lower-numbered iron shots that are "pushed" to the right of the intended target and for short or higher-numbered iron shots that are "pulled" to the left of the intended target.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 2:
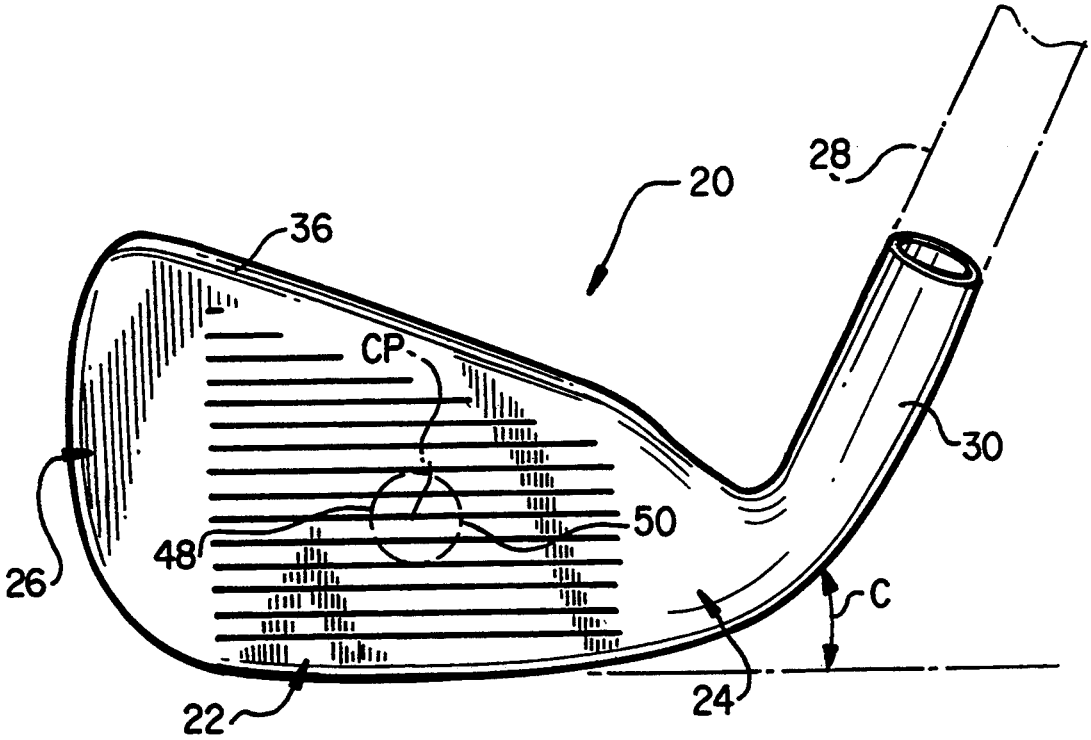
FIG. 2 is a front view or face view of the club head of either FIG. 1A or FIG. 1B.

FIG. 2 illustrates an iron club head 20 according to a first preferred embodiment of the present invention. The iron club head 20 has a ball-striking face 22, a heel portion 24, and a toe portion 26. The face 22 has a center of percussion or "sweet spot" CP, which represents the spot of desired contact with the ball. This center of percussion CP is preferably located at approximately the center of the face 22 and has a diameter of approximately 1.685 inches, which is the diameter of a golf ball designed to meet the specifications of the United States Golf Association. However, depending on the size of the club head 20, the center of percussion CP could have a slightly larger size, and could extend a small distance in any direction from the exact center of the face 22.

A shaft 28 is connected to the club head 20 through a hosel 30 disposed adjacent the heel portion 24. The hosel 30 has an opening which receives the shaft 28. The shaft 28 may be of any particular configuration so long as it provides for the proper swing, and may be made from stainless steel or reinforced composites, such as boron, graphite, titanium or aluminum.

Referring now to FIGS. 1–6, the club head 20 further comprises a sole 32, a rear surface 34 and a top ridge 36. The shape and size of the iron club head may be that of any conventional iron club head, and is not critical to the present invention. The iron club head 20 is preferably made from investment cast metal, such as iron or aluminum, but may also be made from composite material, such as kevlar, graphite or carbon. Thus, the use of the term "iron" herein includes club heads made of either metal or composite material.

FIGS. 1A, 4A, 5A and 6A illustrate a three-iron club head 20A according to the present invention. FIGS. 1B, 4B, 5B and 6B illustrate a nine-iron club head 20B which is adapted to be used with the three-iron 20A in a matching set of iron club heads according to the present invention. The three-iron 20A and the nine-iron 20B shown and described herein are exemplary of the other irons in the set. Therefore, the other club heads within this set of irons shall not be described in detail hereinbelow, except to note the differences between the respective club heads. The basic elements of the nine-iron 20B are the same as the elements for the three-iron 20A, except as distinguished hereinbelow. Therefore, the same numeral designation shall be used for both the three-iron 20A and the nine-iron 20B; however, the numeral designation for the elements of the three-iron 20A shall end with an "A", while the numeral designation for the elements of the nine-iron 20B shall end with an "B". For FIGS. 2 and 3, the "A" and "B" designations are omitted because both the three-iron 20A and the nine-iron 20B would have the same elements shown in these Figures.

Referring to FIG. 4, the faces 22A and 22B are angled at an angle A1 or B1 when the respective sole 32A or 32B is rested flat on the ground. The angled face 22A or 22B provides loft to help launch the ball into the air. Lower angles or loft tend to launch the ball at a lower trajectory, while higher angles or loft tend to launch the ball at a higher trajectory. Typically, the loft or angle of a lower-numbered club head, for example, the three-iron, is lower than the loft or angle of a higher-numbered club head, for example, the nine-iron.

The club head 20 is provided with a weighting system that comprises three types of weights or masses. A first type of weight is a sole weight 40A or 40B which is provided along the sole 32A or 32B. The sole weight 40A or 40B preferably extends along the length of the sole 32A or 32B from the heel portion 24A or 24B to the toe portion 26A or 26B, although it could extend along a lesser length of the sole 32A or 32B. This sole weight 40A or 40B adds weight below the desired point of impact CP of the golf ball, thereby creating a higher trajectory for the flight of the ball.

Figure 1A:
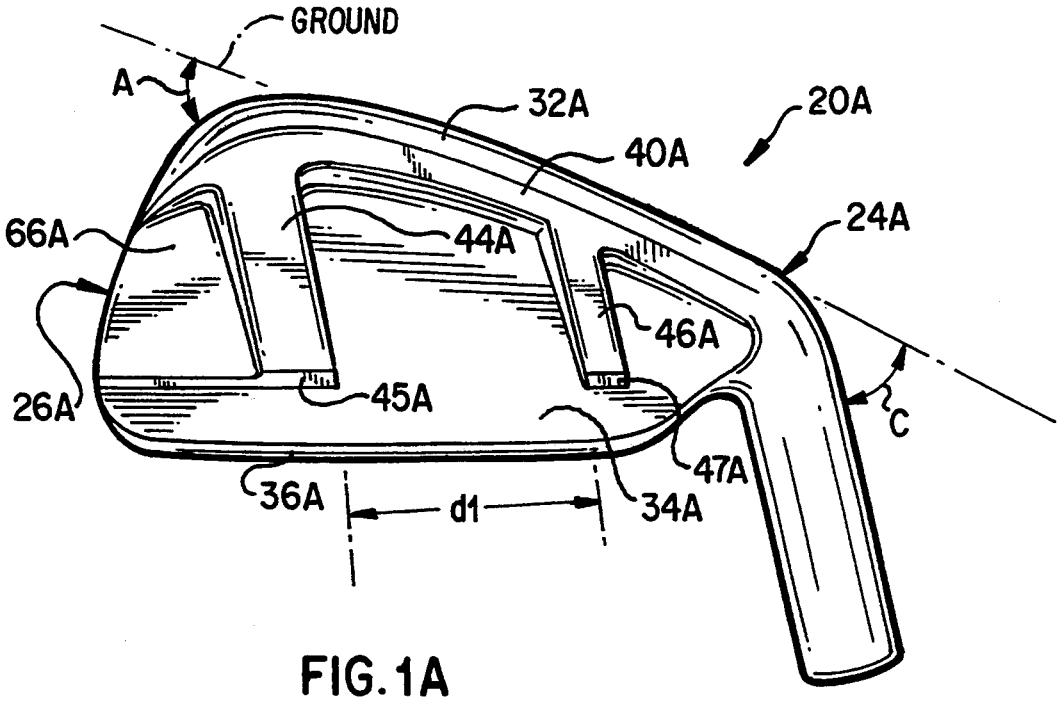
FIG. 1A is a rear perspective view of a three-iron club head according to a first embodiment of the present invention.
Figure 1B:
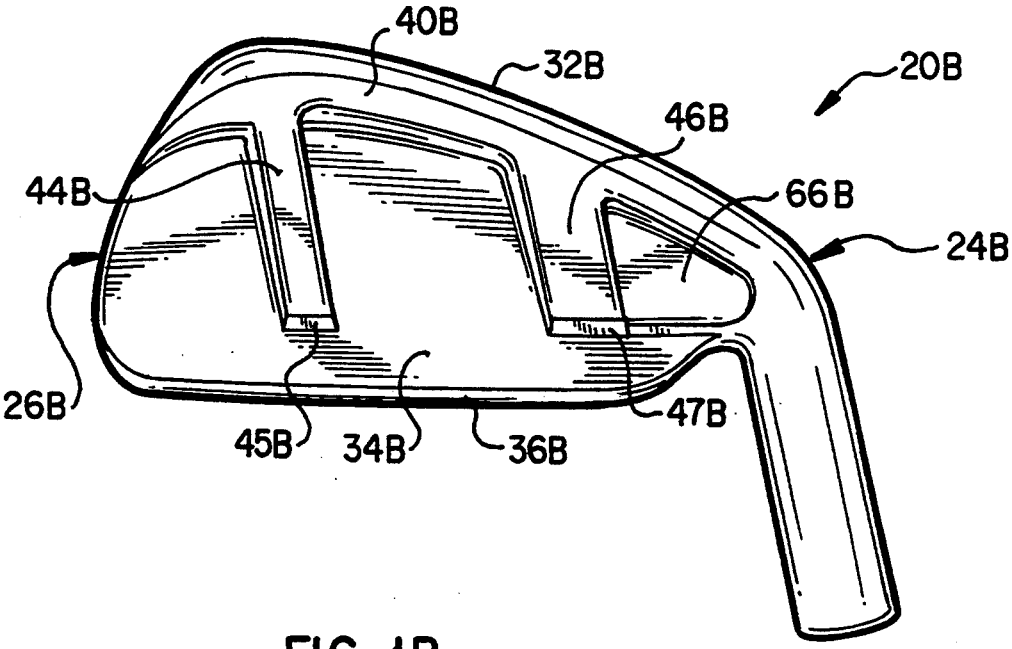
FIG. 1B is a rear perspective view of a nine-iron club head according to the first embodiment of the present invention.

Referring also to FIGS. 1A and 1B, a second type of weight comprises a pair of slanted rails 44A or 44B and 46A or 46B. One rail 44A or 44B is preferably positioned on the rear surface 34A or 34B behind the approximate location of the extreme point 48 of the center of percussion CP closest to the toe portion 26A or 26B, while the other rail 46A or 46B is preferably positioned on the rear surface 34A or 34B behind the approximate location of the extreme point 50 of the center of percussion CP closest to the heel portion 24A or 24B. The distance between the centers of the two rails 44 and 46 is preferably about 1.685 inches, which is the diameter of a golf ball designed to meet the specifications of the United States Golf Association. Alternatively, each rail 44 or 46 may be positioned at any point between an extreme point 48 or 50 of the center of percussion CP and the outermost point of either the heel portion 24 or the toe portion 26. Thus, these rails 44A or 44B and 46A or 46B are positioned behind the approximate center of the face 22A or 22B.

Referring to FIGS. 4–6, the thickness of each rail 44 and 46 decreases progressively from its bottom, where it connects with the sole weight 40A or 40B, to its upper tip 45A or 45B and 47A or 47B, respectively. Thus, more weight is provided near the bottom of the rails 44 and 46 to improve the launch angle, thereby obtaining a higher trajectory on shots. The outer surfaces 49A, 49B and 51A, 51B of the rails 44A, 44B and 46A, 46B, respectively, are shown in FIGS. 4–6 as being curved, but the outer surfaces 49A, 49B and 51A, 51B may also be straight or linear.

The rails 44 and 46 are also preferably slanted or angled. Specifically, each rail 44 or 46 is disposed at an angle C which substantially corresponds to the angle of the hosel 30 of each club head with respect to the sole 32, that is, when the sole 32 is rested flat on the ground in the address position (see FIGS. 1A and 2). Since the hosel 30 of each club in the set, from the one-iron to the wedges, has a different angle, the angle C of the rails 44 and 46 for each club head 20 will also be different. For example, the angle C for a three-iron is approximately 58 degrees, while the angle C for a nine-iron is approximately 64 degrees.

The angle of the rails 44 and 46 preferably correspond to the angle C of the hosel 30 for two reasons. First, the weight or mass of the rails 44 and 46, when the rails are aligned to the angle of the hosel 30, will work together to help drive the ball accurately down the desired target line by reducing the twisting effect on the club head 20 as it contacts the ball. Second, the rails 44 and 46 are preferably angled to counteract the centrifugal forces of a golf swing. Specifically, the centrifugal forces of a swing cause the shaft 28 to bow downwardly during a downswing, thereby causing the club head 20 to change its position. Therefore, the angled rails 44 and 46 will actually be more vertically aligned with the desired target line when the club head 20 impacts the ball.

The width, and therefore the weight, of the two rails 44 and 46 are also different to help the golfer hit a golf ball more accurately. When a golf ball is not struck directly at the center of percussion CP (that is, "off-center"), the club head 20 is easily rotated, thereby resulting in balls hit either to the left or to the right of the desired target. The length of lower-numbered irons is longer than the length of higher-numbered irons, so that on an off-center hit, a longer iron tends to open its club face 22, thereby deflecting the ball to the right. Conversely, for a shorter iron, an off-center hit tends to close the club face 22, thereby deflecting the ball to the left.

Therefore, for the three-iron shown in FIG. 1A, rail 44A is wider and therefore heavier than rail 46A because more weight is needed nearer the toe portion 26A. The additional weight in rail 44A for the lower-numbered irons, such as the three-iron, will counteract the deflection of the ball to the right and cause the ball to travel closer to the desired target line. Conversely, for the nine-iron shown in FIG. 1B, rail 46B is wider and therefore heavier than rail 44B because more weight is needed nearer the heel portion 24B. The additional weight in rail 46B for the higher-numbered irons, such as the nine-iron, will counteract the deflection of the ball to the left and cause the ball to travel closer to the desired target line.

In other words, for a set of iron club heads according to the present invention, the weight of rail 44 is heaviest and the weight of rail 46 is lightest for a one-iron (the longest iron), and the weight of rail 44 becomes progressively lighter while, simultaneously, the weight of rail 46 becomes progressively heavier for the two-iron through the nine-iron and the wedges, so that the weight of rail 44 is lightest and the weight of rail 46 is heaviest for the wedges (the shortest irons).

A third type of weight comprises a weight piece 66A or 66B that is provided at the rear surface 34A or 34B. For one-irons to six-irons according to the present invention, a weight piece 66A is provided between the rail 44A and the extremity of the toe portion 26A. For seven-irons to the wedges according to the present invention, a weight piece 66B is provided between the rail 46B and the extremity of the heel portion 24B. Thus, the weight pieces 66A and 66B further assist in compensating for the tendencies of a particular club to hit the ball to either the left or the right.

In the embodiments shown in FIGS. 1–8, each weight piece 66A and 66B is provided with the same shape, size and weight, regardless of which club head it is used with. Alternatively, the weight pieces 66A and 66B may be progressively weighted, such that weight piece 66A is heaviest for a one-iron and becomes progressively lighter so that it is lightest for a six-iron, while weight piece 66B is lightest for a seven-iron and becomes progressively heavier so that it is heaviest for a wedge. However, the shape and size of the weight pieces 66A and 66B are not important, and they can be provided in any shape or size.

Each of the three types of weights, specifically sole weight 40, rails 44 and 46, and weight pieces 66A and 66B, may be formed integrally with the club head 20 so that they appear as raised surfaces extending from the rear surface 34 (see FIGS. 1, 4, 5 and 6). In particular, the rails 44 and 46 preferably extend to the sole 32. Alternatively, the rails 44 and 46 and the weight pieces 66A and 66B may be provided as separate pieces that are then welded, brazed or epoxied to the rear surface 34.

Figure 3:
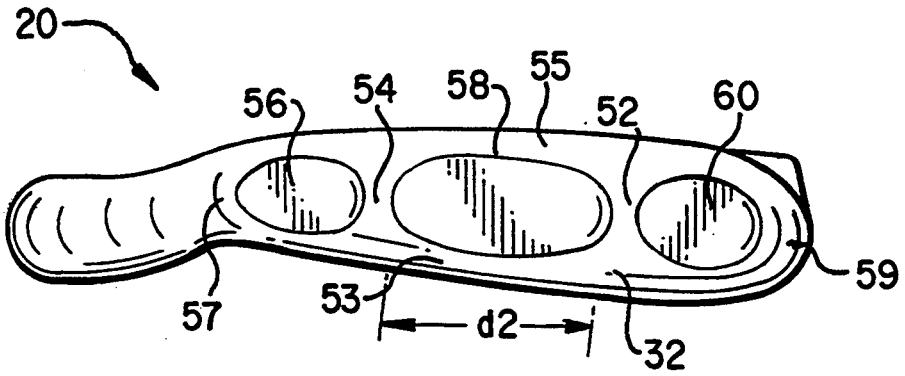
FIG. 3 is a bottom plan view or sole view of the club head of either FIG. 1A or FIG. 1B.
Figure 5A:
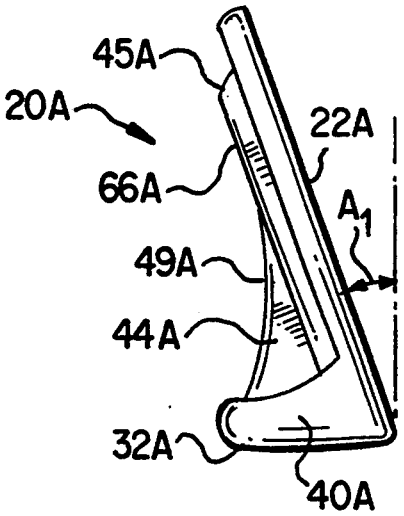
FIG. 5A is a toe view of the club head of FIG. 1A.
Figure 5B:
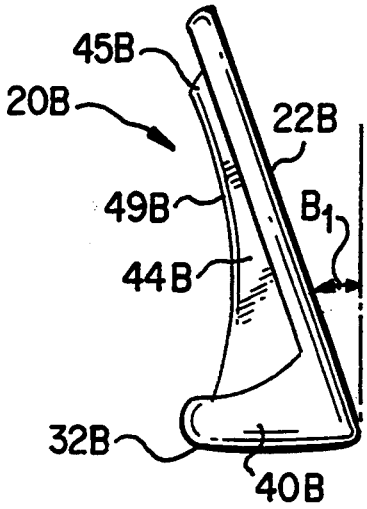
FIG. 5B is a toe view of the club head of FIG. 1B.
Figure 4A:
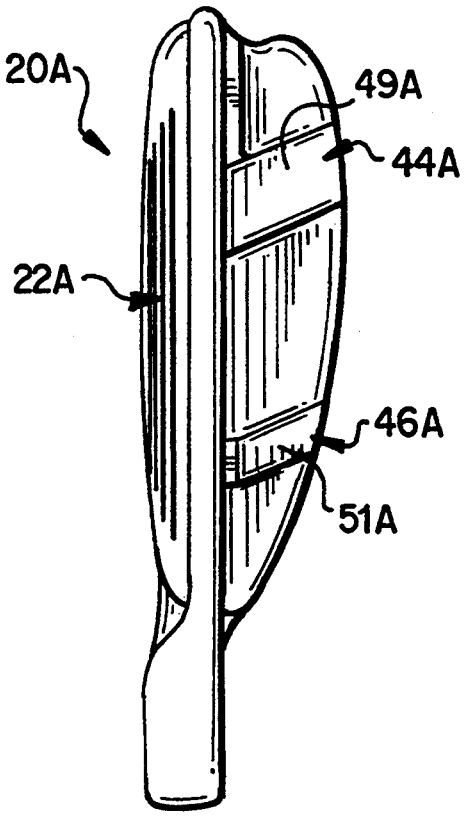
FIG. 4A is a top plan view of the club head of FIG. 1A.
Figure 4B:
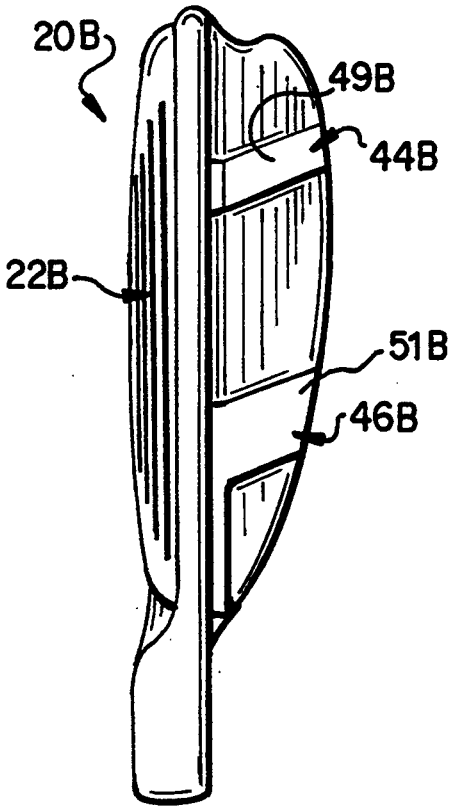
FIG. 4B is a top plan view of the club head of FIG. 1B.
Figure 6A:
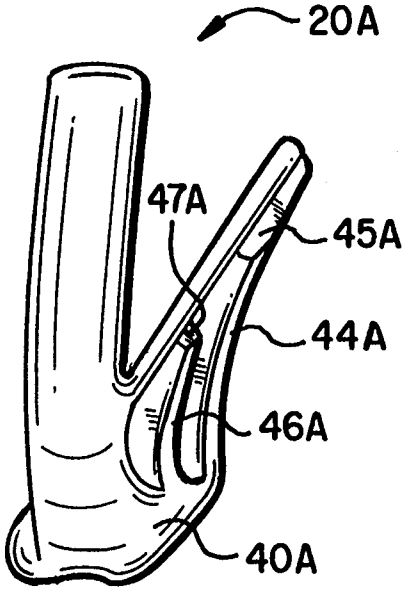
FIG. 6A is a heel view of the club head of FIG. 1A.
Figure 6B:
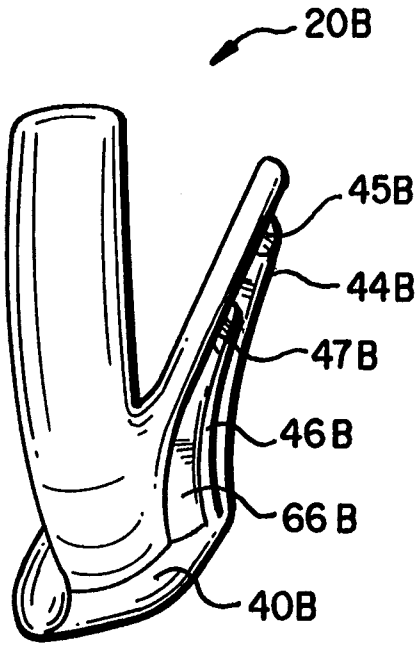
FIG. 6B is a heel view of the club head of FIG. 1B.

The sole 32 of the club head 20 form three beveled regions. Referring specifically to FIG. 3, two flat regions 52 and 54 define three beveled regions 56, 58 and 60. The two flat regions 52 and 54, together with the front edge surface 53, the rear edge surface 55, the heel edge 57 and the toe edge 59, constitute the sole 32. The flat regions 52 and 54, and the edges 53, 55, 57 and 59, allow the club head 20 to rest flat on the ground at the address position without requiring the golfer to manipulate the position of the club head 20. The two outer beveled regions 56 and 60 also allow the club head 20 to rest flat against the ground when the ball is addressed on uphill or downhill lies. For example, the beveled region 56 allows the club head 20 to rest flat against the ground on an uphill lie, and the beveled region 60 allows the club head 20 to rest flat against the ground on a downhill lie. Depending on the lie, the corresponding beveled region 56 or 60 reduces the possibility of the sole 32 catching the ground upon impact during these awkward lies, which would otherwise cause the club head 20 to be twisted off line.

Some non-limiting dimensions will now be provided, although it will be appreciated by those skilled in the art that these dimensions represent mere examples, and that these dimensions may be modified without departing from the spirit and scope of the present invention. For instance, the thickness of the club head 20 between the club face 22 and the rear surface 34 preferably ranges between 3 and 6 mm, and is preferably about 4 mm. The thickness of the weight pieces 66A and 66B preferably ranges between 1 and 4 mm, and is preferably about 2 mm. The width of the rail 44 preferably ranges between 5 and 10 mm, depending on the club, while the width of the rail 46 preferably ranges between 10 and 5 mm, again depending on the club. The thickness of each rail 44 and 46 at the upper tips 45 and 47 preferably ranges from 1 to 5 mm, while the thickness of the bottom of the rails 44 and 46 adjacent the sole 32 preferably ranges from 10 to 20 mm. The distance d1 between the two rails 44A, 44B and 46A, 46B is preferably the same for each club, regardless of its length, and preferably ranges from 1.3 to 1.45 inches. Alternatively, the distance d1 between the two rails 44 and 46 may be varied depending on the club, but should preferably be within the range specified above. The width of the flat sole regions 52 and 54 preferably ranges from about 0.3 to 0.4 inches, and the width d2 of the bevel 58 preferably ranges from about 0.9 to 1.25 inches.

It will be appreciated by those skilled in the art that modifications to the structure of the club head 20 shown and described above may be provided without departing from the spirit and scope of the present invention. By way of example only, and in no way intending to limit the alternatives that can be encompassed by the appended claims, it is not necessary that only one-irons through six-irons have a weight piece 66A adjacent the toe portion 26A only, or that only seven-irons through the wedges have a weight piece 66B adjacent the heel portion 24B only; it is possible for each weight piece 66A or 66B to be provided on any of the clubs from one-iron to wedges, either individually, or even with both weight pieces 66A and 66B together on the same club, as long as the weighting of each club head has been adjusted according to the principles described above. Likewise, the size, shape and weight of the weight pieces 66A and 66B may also be varied as desired.

In this regard, the weighting, size and shape of each of the rails 44 and 46 and the weight pieces 66A and 66B may be provided in a variety of ways, for example:

| Rails 44 and 46 | Weight Pieces 66A and 66B |
|---|---|
| Vary weight throughout set. | Same weight throughout set. |
| Same weight throughout set. | Vary weight throughout set. |
| Vary weight throughout set. | Vary weight throughout set. |

Further, although the club head 20 of the present invention has been illustrated as having two rails 44 and 46, three or more rails may also be provided in spaced-apart manner across the rear surface 34 of the club head 20. Similarly, a weight piece similar to the weight pieces 66A and 66B could be provided between the two rails 44 and 46.

Thus, the present invention provides an iron club head which concentrates more weight or mass at specific locations to help the golfer achieve greater accuracy and increased distance on golf shots. This is accomplished by providing three types of weights, (1) a sole weight 40 for increasing the trajectory of the shot, (2) a pair of rails 44 and 46 provided directly behind the center of percussion CP to provide mass on each side of the ball to reduce club head torque and to provide support and accuracy to shots that are struck on the toe or heel portions of the club face, and (3) one or two weight pieces 66A and/or 66B provided adjacent the heel and/or toe portions 24 and/or 26, respectively, to create a counterbalance for long or lower-numbered iron shots that are "pushed" to the right of the intended target and for short or higher-numbered iron shots that are "pulled" to the left of the intended target.

While the description above refers to particular embodiments of the present invention, it will be understood that many modifications may be made without departing from the spirit thereof.

What is claimed is:

1. A set of iron golf clubs, each golf club comprising a shaft and a club head, the set of iron golf clubs comprising:

(a) a plurality of lower-numbered iron golf clubs, each comprising a club head comprising:

a sole, a toe portion, a heel portion and a rear surface;

a ball-striking face having a center of percussion located at an approximate center of the face, the center of percussion having a first extremity closer to the toe portion and a second extremity closer to the heel portion;

a first weight provided adjacent the sole;

a second weight provided on the rear surface, the second weight comprising at least two rails, with a first rail positioned between the first extremity of the center of percussion and the toe portion, and a second rail positioned between the second extremity of the center of percussion and the heel portion; and a third weight provided on the rear surface between the first rail and the toe portion;

wherein the first rail of each lower-numbered iron golf club is progressively narrower than the first rail of the preceding lower-numbered iron golf club, and wherein the second rail of each lower-numbered iron golf club is progressively wider than the second rail of the preceding lower-numbered iron golf club; and (b) a plurality of higher-numbered iron golf clubs which have shafts that are shorter than the shafts of the lower-numbered iron golf clubs, each comprising a club head comprising:

a sole, a toe portion, a heel portion and a rear surface;

a ball-striking face having a center of percussion located at an approximate center of the face, the center of percussion having a first extremity closer to the toe portion and a second extremity closer to the heel portion;

a first weight provided adjacent the sole;

a second weight provided on the rear surface, the second weight comprising at least two rails, with a first rail positioned between the first extremity of the center of percussion and the toe portion, and a second rail positioned between the second extremity of the center of percussion and the heel portion; and a third weight provided on the rear surface between the second rail and the heel portion;

wherein the second rail of each higher-numbered iron golf club is progressively wider than the second rail of the preceding higher-numbered iron golf club, and wherein the first rail of each higher-numbered iron golf club is progressively narrower than the first rail of the preceding higher-numbered iron golf club.

2. The set of iron golf clubs of claim 1, wherein for each lower-numbered iron golf club, the first rail is wider than the second rail, and for each higher-numbered iron golf club, the second rail is wider than the first rail.

3. The set of iron golf clubs of claim 2, wherein each club head further comprises a hosel extending from the heel portion at an angle with respect to the sole, and wherein the first and second rails of each club head are angled at substantially the same angle as the angle of the hosel.

4. The set of iron golf clubs of claim 3, wherein the sole of each club head further comprises three beveled regions separated by two flat regions.

5. The set of iron golf clubs of claim 4, wherein each club head of the plurality of lower-numbered iron golf clubs further comprises a fourth weight provided on the rear surface between the second rail and the heel portion.

6. The set of iron golf clubs of claim 4, wherein each club head of the plurality of higher-numbered iron golf clubs further comprises a fourth weight provided on the rear surface between the first rail and the toe portion.

7. The set of iron golf clubs of claim 1, wherein the third weight of each lower-numbered iron golf club is progressively lighter than the third weight of the preceding lower-numbered iron golf club.

8. The set of iron golf clubs of claim 7, wherein the third weight of each higher-numbered iron golf club is progressively heavier than the third weight of the preceding higher-numbered iron golf club.

9. The set of iron golf clubs of claim 1, wherein the weight of the third weight of each lower-numbered iron golf club is the same.

10. The set of iron golf clubs of claim 9, wherein the weight of the third weight of each higher-numbered iron golf club is the same.

* * * * *